United States Patent [19]

Schroether

[11] Patent Number: 4,563,721

[45] Date of Patent: Jan. 7, 1986

[54] CIRCUIT ARRANGEMENT FOR ACTUATING ELECTROMAGNETIC SWITCHGEAR

[75] Inventor: Gerhard Schroether, Amberg, Fed. Rep. of Germany

[73] Assignee: Siemens Aktiengesellschaft, Munich and Berlin, Fed. Rep. of Germany

[21] Appl. No.: 540,086

[22] Filed: Oct. 7, 1983

[30] Foreign Application Priority Data

Oct. 27, 1982 [DE] Fed. Rep. of Germany ..... 3239840

[51] Int. Cl.[4] ..... H01H 47/18

[52] U.S. Cl. ..... 361/196; 361/154; 361/198

[58] Field of Search ..... 361/152, 154, 155, 156, 361/195, 196, 198

[56] References Cited

U.S. PATENT DOCUMENTS 3,683,301 8/1972 Boley et al. ..... 361/198 X
4,214,290 7/1980 Sloan ..... 361/154
4,376,476 3/1983 Hagiri ..... 361/154 X

OTHER PUBLICATIONS

"7PU20-The New Electronic Time Relay"-Vester Siemens Power Engineering Product News 1, (1981), p. 11.

Siemens Catalog NS 2, (Jan. 1974).

*Primary Examiner*—Harry E. Moose, Jr.
*Attorney, Agent, or Firm*—F. W. Powers; J. F. James

[57] ABSTRACT

The invention relates to a circuit arrangement for actuating exciting coils for electromagnetic switchgear. A transistor is connected in series with the exciting coil, as an electronic switch. Parallel with the series connection are a capacitor and a clock generator, which opens and closes the transistor with a certain frequency. Thereby, upon opening, a defined turn-off delay of the electromagnetic switchgear, and upon switching on, with the use of a timing element which at first deactivates the clock generator, the effect of a d-c saver circuit for electromagnetic switchgear can be achieved.

21 Claims, 3 Drawing Figures

CIRCUIT ARRANGEMENT FOR ACTUATING ELECTROMAGNETIC SWITCHGEAR

BACKGROUND OF THE INVENTION

The invention relates to apparatus for actuating exciting coils of electromagnetic switchgear using an on-off switch and a capacitor that is connected in parallel with the actuating voltage.

Siemens Catalog NS2 (January 1974), discloses a circuit arrangement in which in order to obtain a long break delay, for example for bridging brief voltage interruptions in the control circuit, an energy accumulator in the form of a capacitor is connected parallel to the circuit breaker coil. This capacitor, upon failure of the control voltage, discharges through the coil so that the circuit breaker magnetic remains closed for a prolonged period of time. To obtain reproducible switching times the capacitor must be charged with d-c voltage. Furthermore, for reasons of a sufficient time constant, a circuit breaker-driving magnet system which is suitable for d-c operation even without wiring, must be used in the the discharge loop.

However, when the above circuit arrangement is used with circuit breakers already in service it is impossible in a-c controls to increase the opening delay simply by adding a component, because a-c systems have too small a resistance for d-c actuation and therefore, also a time constant which is insufficient for the discharge.

SUMMARY OF THE INVENTION

The object of the invention is to improve the above circuit arrangement so that in order to obtain an opening delay by using a capacitor that can be charged with direct current, the use of an a-c magnet system is possible without significant increases in cost.

This object is achieved by connecting a clock generator in parallel with the capacitor and connecting an electronic switch, controlled by the clock generator, ahead of the exciting coil.

When using the circuit as a delayed-action circuit breaker, the tripping times can be adjusted in a simple manner if the clock generator is adjustable. To be able to use the circuit arrangement also for an a-c operated circuit breaker drive which is connected to a d-c source, it is advantageous if a timing element is also connected ahead of the clock generator. This will eliminate the need for special measures such as, d-c circuits with series resistances, which are bridged for switching on, and double winding systems which operating and holding windings. Here, too, adjusting the timing element may be of advantage. If a bypass diode is connected in parallel with the exciting coil, reduction of the coil energy is retarded during the no-current interval set by the clock generator through the electronic switch. To be able to connect circuit breaker drives which are normally a-c operated, to a d-c source, it is advantageous if the circuit is preceded by a diode in the conducting direction of the electronic switch. In the case of connection to an a-c source, this diode is needed anyway for charging the capacitor with d-c voltage. For simple conversion of commercial electromagnetic switchgear in accordance with the invention, it is advantageous if the components of the circuit are combined to form a unit electrically and mechanically connectable with the electromagnetic switchgear.

Other features and advantages of the present invention will become apparent from the following detailed description, and from the claims.

For a full understanding of the present invention, reference should now be made to the following detailed description and to the accompanying drawings.

BRIEF DESCRIPTION OF THE DRAWINGS

An embodiment of the invention will be described with reference to the drawings which are described as follows.

DETAILED DESCRIPTION

Figure 1:
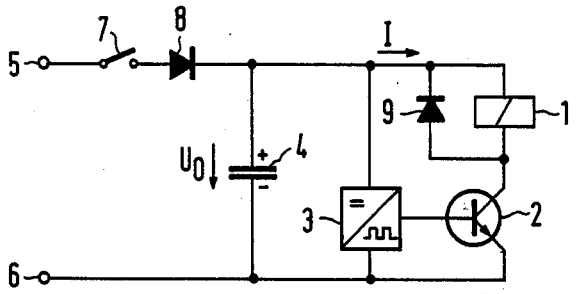
FIG. 1 is a schematic diagram of the circuit arrangement usuable for delayed turn-off.

In the circuit arrangement of FIG. 1, the series connection consisting of an exciting coil and transistor 2, forms the electronic switch which is connected in parallel with clock generator 3 and capacitor 4. The parallel connection is already disconnected from supply terminals 5, 6 by open switch 7. Diode 8 makes it possible to connect the circuit arrangement both to a-c voltage and to d-c voltage. Directly parallel with exciting coil 1 is bypass diode 9.

The operation of the circuit arrangement will now be described in detail.

Figure 2:
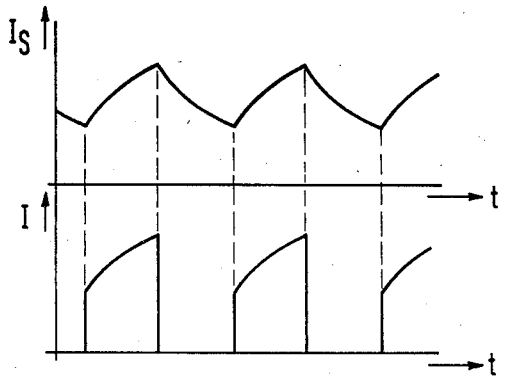
FIG. 2 shows the current flow versus time in the coil circuit and in the total circuit.

If either switch 7 is opened after having been closed, or the voltage at supply terminals 5, 6 is interrupted briefly, the capacitor, which has been charged to the voltage $U_o$, will discharge via exciting coil 1 with the switching frequency determined by clock generator 3, which operates in a wide voltage range. The discharge time is determinable through the clock frequency. Bypass diode 9 brings about a retardation of the reduction of the coil energy during the no-current interval given by clock generator 3 through transistor 2, so that the current flow in coil $I_s$ versus time, as shown in FIG. 2, results. I as a function of time represents the current flow in the discharge loop during strobing. Therefore, as shown in FIG. 2, the current flow $I_s$ in the exciting coil does not go all the way to zero during strobing, so that as long as capacitor 4 supplies the necessary voltage, the electromagnetic switchgear remains turned on.

Figure 3:
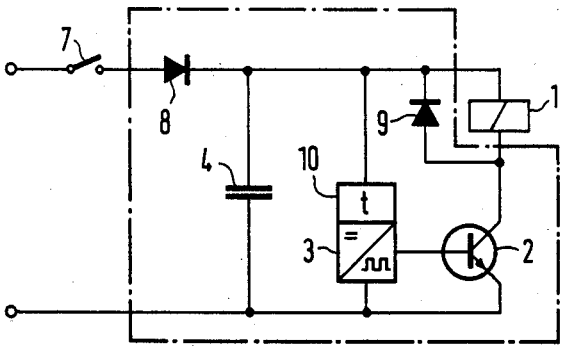
FIG. 3 is a schematic diagram of the circuit arrangement according to FIG. 1, for use as a d-c saver circuit, in which a timing element is connected ahead of the clock generator.

Referring to FIG. 3, if switch 7 is closed, capacitor 4 is charged via diode 8. Timing element 10, cooperating with clock generator 3, first causes the capacitor to switch transistor 2 for a given time corresponding to the timing element. Thereby, exciting coil 1 receives an ON command, and the desired high current, limited only by the ohmic coil resistance, allows the electromagnetic switchgear to switch on. At the end of the given time, which approximately equals the closing time of the magnet system, clock generator 3 changes over to strobing. The pulse-interval ratio should be chosen so that the circuit breaker coil is not thermally overloaded. This has been assured in existing arrangements by insertion of the saver resistance. With the circuit arrangement embodied in this invention, an arrangement has been provided which can take over the function of delayed-action circuit breakers in addition to the function of d-c saver circuits, without the need for any separate expenditures.

There has thus been shown and described a novel circuit arrangement for actuating electromagnetic switchgear which fulfills all the object and advantages sought. Many changes, modifications, variations and other uses and application of the subject invention will, however, become apparent to those skilled in the art after considering this specification which discloses embodiments thereof. All such changes, modifications, variations and other uses and applications which do not depart from the spirit and scope of the invention are deemed to be covered by the invention which is limited only by the claims which follow.

I claim:

1. In a circuit arrangement for energizing and delayed de-energizing of exciting coils of an electromagnetic switchgear using a capacitor parallel to an excitation voltage source and an on-off switch for the arrangement, the improvement comprising a clock generator, connected in parallel with the capacitor, and an electronic switch, controlled by the clock generator, connected ahead of the exciting coil.

2. The circuit arrangement according to claim 1, further comprising a timing element connected ahead of the clock generator.

3. The circuit arrangement according to claim 1, wherein the clock generator is adjustable.

4. The circuit arrangement according to claims 1 or 2, further comprising a bypass diode connected in parallel with the exciting coil.

5. The circuit arrangement according to claim 3, further comprising a bypass diode connected in parallel with the exciting coil.

6. The circuit arrangement according to claims 1 or 2, further comprising a diode, preceding the circuit arrangement and connected in the conducting direction of the electronic switch.

7. The circuit arrangement according to claim 3, further comprising a diode, preceding the circuit arrangement and connected in the conducting direction of the electronic switch.

8. The circuit arrangement according to claim 4, further comprising a diode, preceding the circuit arrangement and connected in the conducting direction of the electronic switch.

9. The circuit arrangement according to claim 5, further comprising a diode, preceding the circuit arrangement and connected in the conducing direction of the electronic switch.

10. The circuit arrangement according to claims 1 or 2, wherein the circuit arrangement comprises a unit, connectable electrically and mechanically with the electromagnetic switchgear, said unit comprising the components of the circuit arrangement.

11. The circuit arrangement according to claim 3, wherein the circuit arrangement comprises a unit, connectable electrically and mechanically with the electromagnetic switchgear, said unit comprising the components of the circuit arrangement.

12. The circuit arrangement according to claim 4, wherein the circuit arrangement comprises a unit, connectable electrically and mechanically with the electromagnetic switchgear, said unit comprising the components of the circuit arrangement.

13. The circuit arrangement according to claim 5, wherein the circuit arrangement comprises a unit, connectable electrically and mechanically with the electromagnetic switchgear, said unit comprising the components of the circuit arrangement.

14. The circuit arrangement according to claim 6, wherein the circuit arrangement comprises a unit, connectable electrically and mechanically with the electromagnetic switchgear, said unit comprising the components of the circuit arrangement.

15. The circuit arrangement according to claim 7, wherein the circuit arrangement comprises a unit, connectable electrically and mechanically with the electromagnetic switchgear, said unit comprising the components of the circuit arrangement.

16. The circuit arrangement according to claim 8, wherein the circuit arrangement comprises a unit, connectable electrically and mechanically with the electromagnetic switchgear, said unit comprising the components of the circuit arrangement.

17. The circuit arrangement according to claim 9, wherein the circuit arrangement comprises a unit, connectable electrically and mechanically with the electromagnetic switchgear, said unit comprising the components of the circuit arrangement.

18. A circuit arrangement for actuating exciting coils of a.c. electromagnetic switchgear from any type source having a partially positive voltage with an average value thereof within the operating range of the circuit arrangement, comprising:

an on-off switch for selectively connecting the circuit arrangement to the voltage source;

a decoupling diode connected in series with said on-off switch;

a capacitor connected to said decoupling diode and to said voltage source, connecting said capacitor essentially in parallel with said voltage source when said decoupling diode is forward biased;

a clock generator generating adjustable frequency clock pulses connected in parallel with said capacitor;

an electronic switch, controlled by said clock pulses, switchably connecting the exciting coil of the a.c. electromagnetic switchgear in parallel with said capacitor under control of said clock pulses; and a bypass diode having an anode connected to a node common for said electronic switch and said exciting coil and a cathode to a common node of said decoupling diode and said capacitor, providing a bypass path for the exciting coil discharge current when said electronic switch switchably disconnects the exciting coil from said capacitor.

19. A circuit arrangement according to claim 18, further comprising: an adjustable timing element connected to said clock generator controlling said electronic switch to switchably connect, for a period of time of said timing element, the exciting coil for initial energizement thereof.

20. A circuit arrangement according to claim 18, wherein the circuit arrangement comprises a unit, connectable electrically and mechanically with the electromagnetic switchgear, said unit comprising the components of the circuit arrangement.

21. A circuit arrangement according to claim 19, wherein the circuit arrangement comprises a unit, connectable electrically and mechanically with the electromagnetic switchgear, said unit comprising the components of the circuit arrangement.

* * * * *

UNITED STATES PATENT AND TRADEMARK OFFICE

CERTIFICATE OF CORRECTION

PATENT NO. : 4,563,721

DATED : January 7, 1986

INVENTOR(S) : Gerhard Schroether

It is certified that error appears in the above-identified patent and that said Letters Patent are hereby corrected as shown below:

In the specification, column 1, line 52, delete "which" and substitute -- with --.

Signed and Sealed this

*Twenty-fifth* Day of *March 1986*

[SEAL]

*Attest:*

DONALD J. QUIGG

*Attesting Officer*

*Commissioner of Patents and Trademarks*